US005137146A

United States Patent [19]

Stonehouse

[11] Patent Number: 5,137,146

[45] Date of Patent: Aug. 11, 1992

[54] HAT BOX

[76] Inventor: Patricia G. Stonehouse, Box 654, R.R. 3, Manotick, Ontario, Canada, K0A 2N0

[21] Appl. No.: 445,033

[22] Filed: Nov. 28, 1989

[30] Foreign Application Priority Data

Jan. 20, 1989 [CA] Canada ..... 588850

[51] Int. Cl.[5] ..... B65D 21/00

[52] U.S. Cl. ..... 206/8; 206/504; 206/509; 206/515

[58] Field of Search ..... 206/504, 509, 8, 515

[56] References Cited

U.S. PATENT DOCUMENTS

| | | | |
|---|---|---|---|
| 1,582,102 | 4/1926 | Tuten | 206/8 |
| 1,891,334 | 12/1932 | Overton | 206/8 |
| 2,488,611 | 11/1949 | Stallings | 206/509 |
| 2,919,800 | 1/1960 | Jarund | 206/499 |
| 3,402,807 | 9/1968 | Hatcher, Jr. | 206/8 |
| 3,819,847 | 6/1974 | Charles | 206/509 |
| 4,453,629 | 6/1984 | Goldberg | 206/509 |

*Primary Examiner*—Joseph Man-Fu Moy

[57] ABSTRACT

The present invention provides a nestable hat box comprising an upper lid member and a lower base member, each of the members having an identical upstanding hollow portion of decreasing cross-section in the vertical direction, each said portion being open at the bottom and said portions being in vertical alignment and a peripheral wall vertically separating said upper and lower members to provide a space between the upper surface of the upstanding portion of the lower member and the lower surface of the upstanding portion of the upper member to accommodate a hat disposed on said upstanding portion of the lower member, said hat box being nestable with similar hat boxes by means of the hollow, open upstanding portion in the base member accommodating the upstanding portion of the upper lid member of another similar hat box.

21 Claims, 3 Drawing Sheets

HAT BOX

The present invention relates to a hat box. In particular the present invention relates to a nestable hat box which is nestable with other similar hat boxes to occupy a minimum of space, provide a pleasing appearance, fully protect the hat contained therein in a desirable embodiment and provide easy accessibility to the hat in each hat box on a selective basis.

At the present time hats are stored, while not in use, individually on shelves on peoples' clothes closets where they are susceptible to damage and deformation. Alternatively, hats to some extent are kept in hat boxes which are usually formed of cardboard, either singly or in nested form, such hat boxes being disclosed, for example, in U.S. Pat. No. 3,402,807 to Hatcher, J.R. issued Sep. 24, 1968; U.S. Pat. No. 2,786,570 to Kirby, H.L. issued Mar. 26, 1957; U.S. Pat. No. 2,157,151 to Berke, A. issued Sep. 30, 1941 and U.S. Pat. No. 3,191,764 to Bennett, D. issued Jun. 29, 1965. However, such hat boxes are not aesthetically pleasing and further occupy a large amount of space in the clothes closet and generally do not provide for nestable stacking of the hats and those hat boxes that do provide for the stacking of hats in a single hat box and do not facilitate easy access to a particular hat in the hat box particularly on a selective basis.

The present invention provides a hat box which is nestable with similar hat boxes to occupy a minimum of space in its nested condition and which at the same time has a pleasing shape and particularly when made of transparent material allows the wearer to select the hat box containing the desired hat from the nestable stack without the necessity of removing hats from the hat box. At the same time the hat box is structured to accommodate a single hat therein, such that the possibility of damage and deformation to the hat during storage and transportation is minimized.

According to the present invention therefore there is provided a nestable hat box comprising an upper lid member and a lower base member, each of the members having an identical upstanding hollow central portion of decreasing cross-section in the vertical direction, each said portion being open at the bottom and said portions being in vertical alignment and a peripheral wall vertically separating said upper and lower members to provide a space between the upper surface of the upstanding portion of the lower member and the lower surface of the upstanding portion of the upper member to accommodate a hat disposed on said upstanding portion of the lower member, said hat box being nestable with similar hat boxes by means of the hollow, open, upstanding portion in the base member accommodating the upstanding portion of the upper lid member of another similar hat box.

The upstanding portion of the members of the hat box decreases in cross-sectional area with height to allow for nestability and at the same time to readily accommodate a single hat in the space between the upstanding portions of the upper lid portion and the lower base portion without damage to the hat. In a particularly preferred embodiment of the present invention the upstanding portion of each member is conical and when the periphery of the members is regular polygonal, such as hexagonal, the upstanding portion is suitably pyramidal. However, when the periphery of the members forming the hat box is round, the upstanding portion, which is preferably conical, has a single rounded side wall which side wall is preferably outwardly convex in the axial direction.

The periphery of each of the upper lid and lower base members is desirably of symmetrical configuration in plan and may be circular, oval or be a regular polygon, particularly a regular hexagon.

The wall of the hat box is suitably formed by interfitting vertical flanges extending around the edges of the upper lid and lower base member. In one embodiment of the present invention the wall is formed by a depending vertical flange around the periphery of the upper member and an interfitting upstanding flange around the periphery of the lower member. Desirably the wall is formed by a depending vertical flange around the periphery of the upper member and an interfitting upstanding flange around the periphery of the lower member, the flange on the upper member desirably lying within the periphery of the flange of the lower member.

However with such a wall structure the upper member is a slightly different configuration than the lower member and for ease and cost of manufacture it is desirable that the upper lid member and the lower base member be of identical configuration. Thus, in a particularly desirable embodiment of the present invention the upper and lower members are of identical configuration with the wall being formed by a flange around the periphery of each member, said flange having an upstanding and depending portion such that the lower end of the depending portion of the flange of the upper member abuts the upper end of the upstanding portion of the flange of a lower member, said abutting ends being adapted to be releasably locked together. Suitably the releasable locking is achieved by a male member extending from the flange on one member cooperating with a detent on the flange of the other member.

The present invention also provides a member for use in the formation, by vertical alignment with another similar member, of a nestable hat box which member has an upstanding hollow portion of decreasing cross-section in the vertical direction, said upstanding portion being open at the bottom and a vertical flange around the periphery thereof having an upstanding portion and a depending portion such that in the formation of the hat box the depending portion of the flange abuts the upstanding portion of the flange of another said member to form a wall vertically separating said members to provide an internal space therebetween dimensioned to accommodate a hat disposed on the upstanding portion of the lower of said members, said abutting portions being adapted to be releasably locked together.

The members of the present invention are most desirably made of rigid plastic sheeting, such as, for example, polyester resin. Desirably the plastic sheeting is transparent so that the hat in the box can be readily identified from the outside without opening the box thus allowing a particular hat box to be selected and removed from the nest of boxes as desired without having to open them or move them around The plastic is suitably 0.015 to 0.100 mm, particularly 0.020 mm thick.

The present invention will be further illustrated by way of the accompanying drawings, in which:

FIG. 5 is an exploded view of the hat box of FIG. 1;

Figure 1:
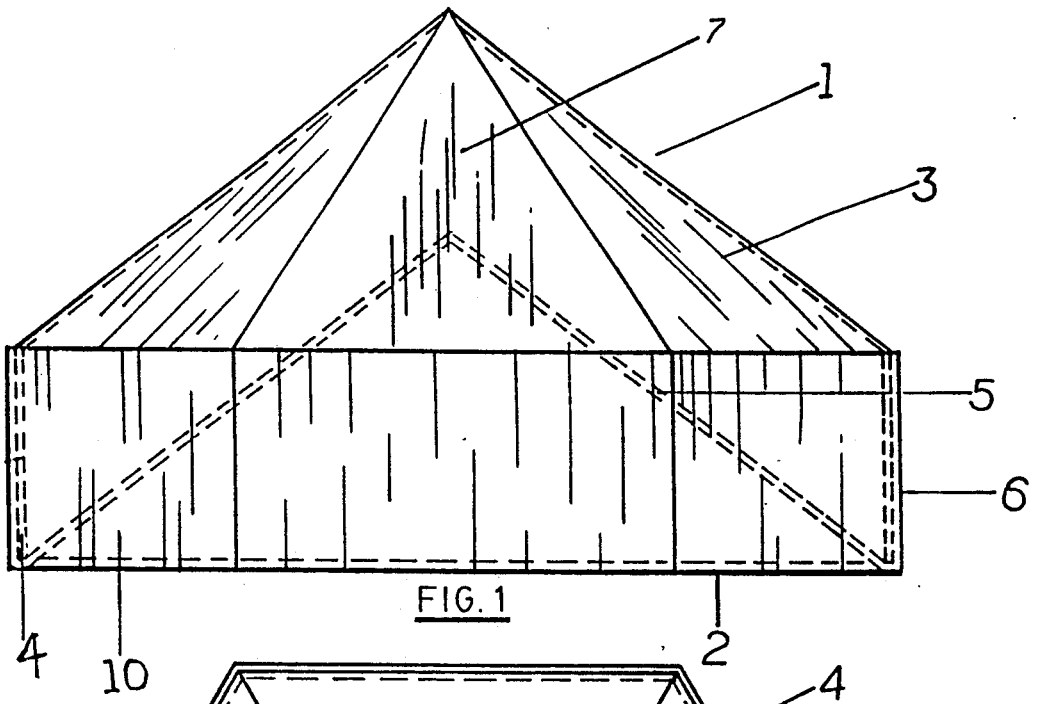
FIG. 1 is a front elevation of a hat box according to one embodiment of the present invention.
Figure 2:
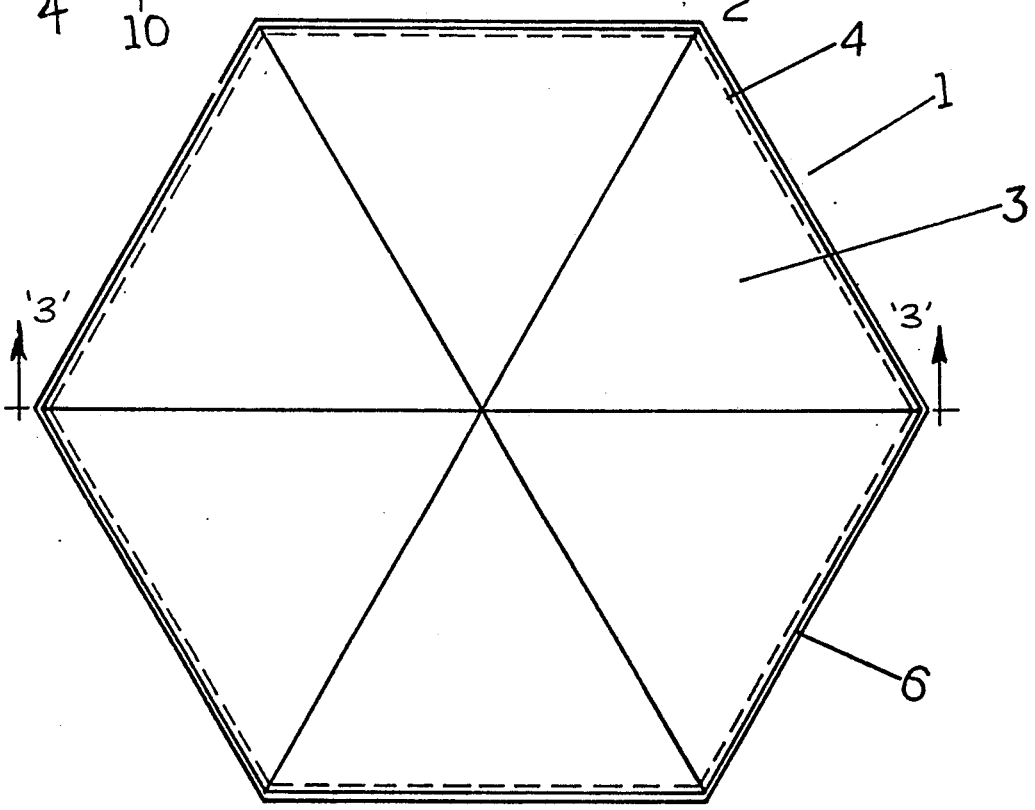
FIG. 2 is a plan view of the hat box of FIG. 1.
Figure 3:
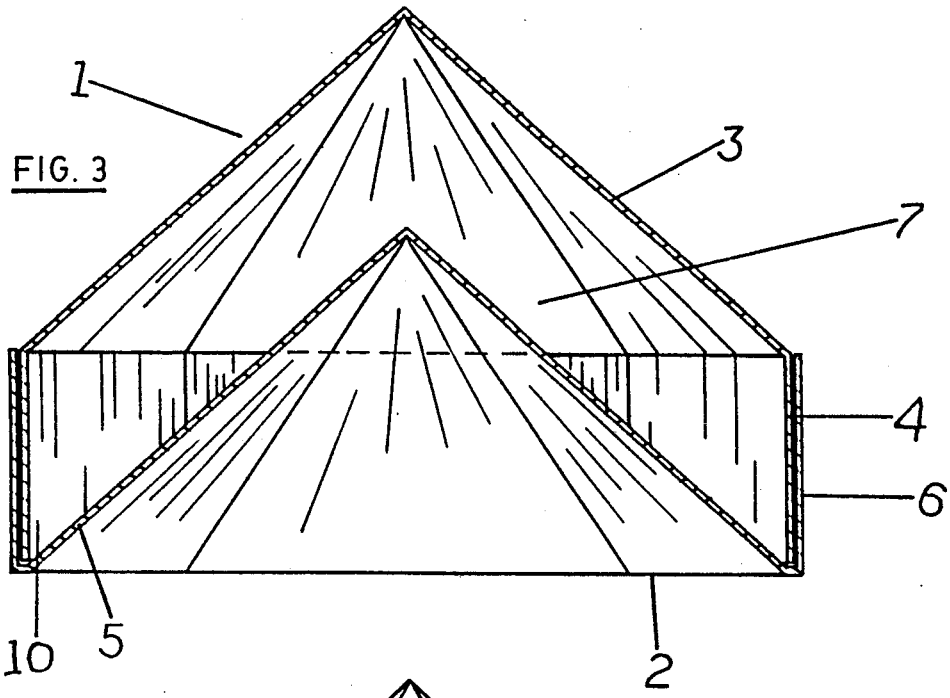
FIG. 3 is a vertical section taken along the line 3—3 in FIG. 2.

Referring firstly to FIGS. 1 to 5 of the drawings, the hat box 10 is formed from an upper lid member 1 and a lower base member 2. The lid member 1 has a hollow open ended pyramidal portion 3 having around the periphery thereof a depending wall 4. The base member also has a hollow open ended pyramidal portion 5 and an upstanding peripheral wall 6. In closing the hat box the lid member 1 is lowered into the base member 2 such that the walls 4 and 6 and the hollow pyramidal portions 3 and 5 which are in alignment interfit as particularly shown in FIG. 3 thus, providing a space 7 for the hat 8 disposed on the upper surface of the pyramidal portion 5 of the base member 2. The members 2 and 3 are desirably formed of transparent rigid plastic so that the hat 8 may be readily seen from outside the hat box.

Figure 4:
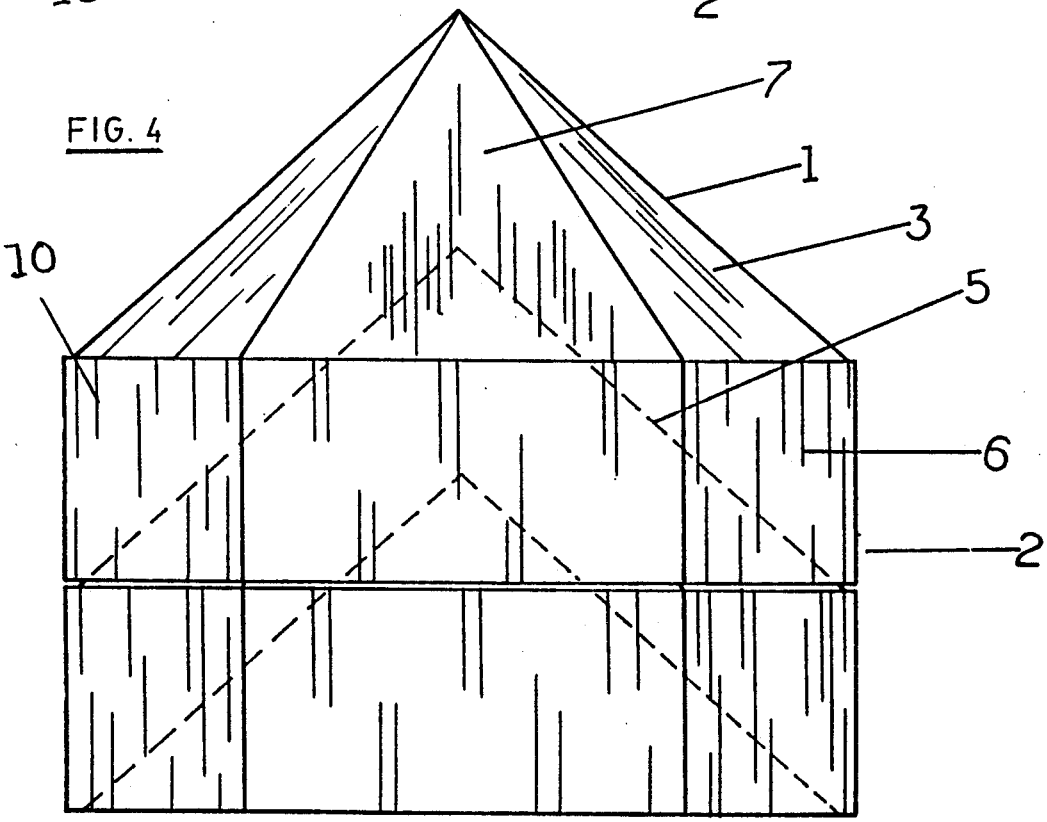
FIG. 4 is a similar elevation as in FIG. 1 of a pair of nested hat boxes.

Referring particularly to FIG. 4, a second hat box 11 of the same configuration may be readily nestably stacked with the first hat box 10 with the pyramidal portions in alignment.

Figure 6:
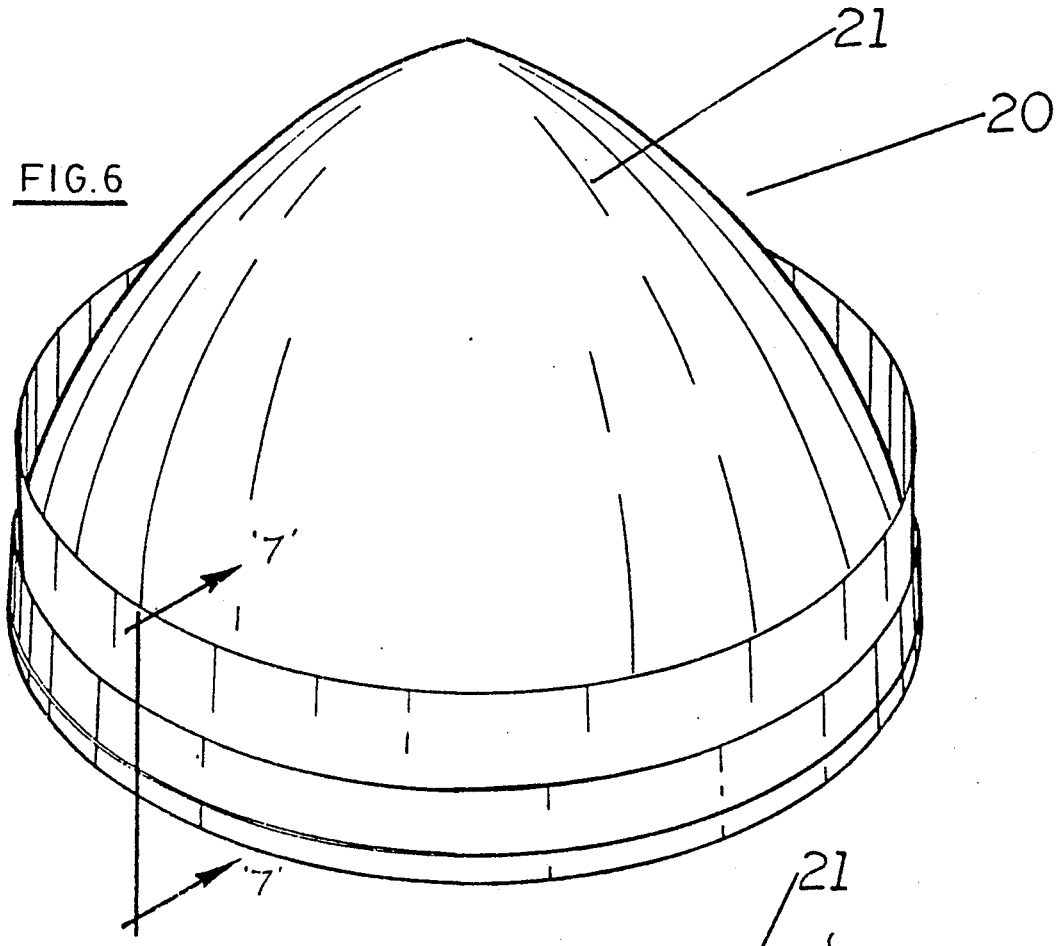
FIG. 6 is a perspective view of a hat box according to another embodiment of the present invention.
Figure 7:
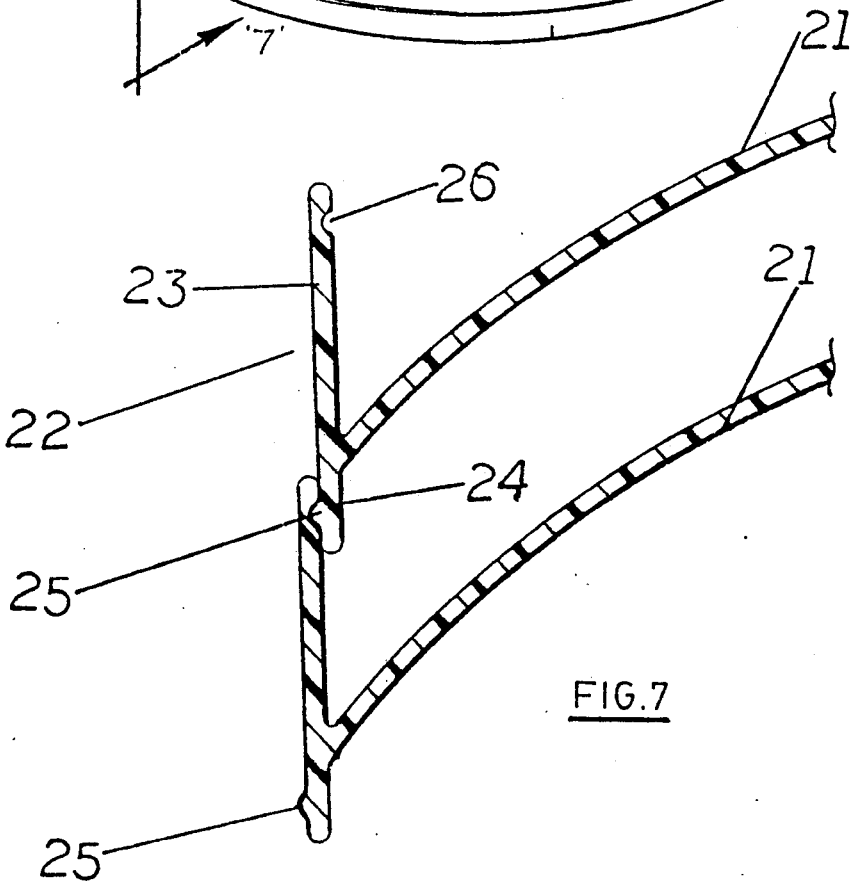
FIG. 7 is a sectional detail taken along the line 7—7 in FIG. 6.

Referring to FIGS. 6 and 7 the hat box 20 is formed from a pair of identical members one of which forms the lid member and another the base member. Each member 20 has a hollow open ended conical portion 21 having a rounded base and axially outwardly convex wall. Around the periphery of the base of the open ended conical portion is a peripheral flange 22 having an upstanding portion 23 and a depending portion 24. The outer surface of the depending portion has a ridge 25 therearound which in the closed condition of the hat box releasably locks into a groove 26 in the inner surface of the upstanding portion 23 of the flange 22.

I claim:

1. A nestable hat box comprising an upper lid member and a lower base member, each of the members having an identical upstanding hollow central portion of decreasing cross-section in the vertical direction, each said portion being open at the bottom and said portions being in vertical alignment, and a peripheral wall vertically separating said upper and lower members to provide and vertically maintain a protective space between the upper surface of the upstanding portion of the lower member and the lower surface of the upstanding portion of the upper member to accommodate and protect the shape of a hat disposed on said upstanding portion of the lower member, said wall being formed by interfitting vertical flanges extending around the edges of each of the members, and said hat box being nestable with similar hat boxes by means of the hollow, open upstanding portion in the base member accommodating the upstanding portion of the upper lid member of another similar hat box.

2. The hat box as claimed in claim 1, in which the upstanding portion is of conical shape.

3. A hat box as claimed in claim 2, in which the upstanding portion is of pyramidal shape.

4. A hat box as claimed in claim 1, 2 or 3, in which the members have in plan a symmetrical shape.

5. A hat box as claimed in claim 1, 2 or 3, in which the members have in plan a rectangular or polygonal shape.

6. A hat box as claimed in claim 1, 2 or 3, in which the members have in plan a regular hexagonal shape.

7. A hat box as claimed in claim 1, 2 or 3, formed of transparent rigid plastic sheeting.

8. A hat box as claimed in claim 1, 2 or 3, in which the wall is formed by a depending vertical flange around the periphery of the upper member and an interfitting upstanding flange around the periphery of the lower member.

9. A hat box as claimed in claim 1, 2 or 3, in which the wall is formed by a depending vertical flange around the periphery of the upper member and an interfitting upstanding flange around the periphery of the lower member, the flange on the upper lying within the periphery of the flange of the lower member.

10. A hat box as claimed in claim 2, in which the members are in plan of round shape.

11. A hat box as claimed in claim 10, in which the side wall of the hollow conical upstanding portion is outwardly axially convex.

12. A hat box as claimed in claim 10 or 11, in which the upper and lower members are of identical configuration with the wall being formed by a flange around the periphery of each member, said flange having an upstanding and depending portion such that the depending portion of the flange of the upper member abuts the upstanding portion of the flange of a lower member, said abutting portions being adapted to be releasably locked together.

13. A hat box as claimed in claim 12, in which the releasable locking is achieved by a male member extending from the flange on one member cooperating with a recess on the flange of the other member.

14. A hat box as claimed in claim 1, 2 or 3, formed of rigid plastic sheeting.

15. A member for use in the formation by vertical alignment with another similar member, of a nestable hat box which member has a upstanding hollow upstanding portion of decreasing cross-section in the vertical direction, said upstanding portion being open at the bottom and a vertical flange around the periphery thereof having an upstanding portion and a depending portion such hat in the formation of the hat box the depending portion of the flange on one said member abuts the upstanding portion of the flange of another said member to form a wall vertically separating said members to provide an internal space therebetween dimensioned to accommodate a hat disposed on the upstanding portion of the lower of said members, said abutting portions being adapted to be releasably locked together.

16. A member as claimed in claim 15, in which the releasable locking is achieved by a male member extending from the flange on one said member cooperating with a recess on the flange of the other said member.

17. A member as claimed in claim 15 in which the upstanding portion is of pyramidal shape.

18. A member as claimed in claim 17 which is in plan of round or oval shape.

19. A member as claimed in claim 18, in which, the side wall of the hollow conical upstanding portion is outwardly axially convex.

20. A hat box as claimed in claim 15, formed of rigid plastic sheeting.

21. A hat box as claimed in claim 15, formed of transparent rigid plastic sheeting.

* * * * *